US005555647A

United States Patent [19]

Torborg et al.

[11] Patent Number: 5,555,647

[45] Date of Patent: Sep. 17, 1996

[54] MOTOR MOUNTED TO BLOWER HOUSING

[75] Inventors: Kevin Torborg; Victor E. Jelinek, both of Webster City, Iowa

[73] Assignee: White Consolidated Industries, Inc., Cleveland, Ohio

[21] Appl. No.: 518,554

[22] Filed: Aug. 23, 1995

[51] Int. Cl.[6] ..... F26B 11/02

[52] U.S. Cl. ..... 34/601; 34/603; 417/360

[58] Field of Search ..... 34/595, 601, 602, 34/603, 604; 248/220.22, 221.11, 223.41; 417/360

[56] References Cited

U.S. PATENT DOCUMENTS

| | | | |
|---|---|---|---|
| 2,287,462 | 6/1942 | Beckett | 417/360 |
| 2,456,488 | 12/1948 | Brown . | |
| 3,429,056 | 2/1969 | Metzger | 34/601 |
| 4,360,977 | 11/1982 | Frohbieter . | |
| 4,756,640 | 7/1988 | Gehrke . | |
| 5,127,169 | 7/1992 | Ellingson | 34/603 |
| 5,133,617 | 7/1992 | Sokn et al. . | |
| 5,203,093 | 4/1993 | Baker | 34/601 |
| 5,216,823 | 6/1993 | Ripley . | |
| 5,232,341 | 8/1993 | Shier et al. | 417/360 |
| 5,317,816 | 6/1994 | Kadakia . | |
| 5,363,569 | 11/1994 | Kadakia . | |
| 5,404,614 | 4/1995 | Stephens | 417/360 |

FOREIGN PATENT DOCUMENTS

| | | | |
|---|---|---|---|
| 3040559 | 8/1988 | Japan | 34/601 |

*Primary Examiner*—Edward K. Look
*Assistant Examiner*—Mark Sgantzos
*Attorney, Agent, or Firm*—Pearne, Gordon, McCoy & Granger

[57] ABSTRACT

An electric fan motor of a domestic clothes dryer is directly secured to an associated plastic blower housing by a locking member which is snap-fit to the blower housing. The blower housing includes an arcuate support member which supports a hub of the motor. The locking member includes an arcuate securing portion which overlies the hub and cooperates with the support member to define a socket which secures the hub to the blower housing. The blower housing has an open side which is covered by a metal blower cover. The blower cover is snap-fit to the blower housing, and has a thermostat mounted thereto. The thermostat is electrically connected to ground via the blower cover and a fastener inserted into a base of the clothes dryer cabinet.

20 Claims, 4 Drawing Sheets

MOTOR MOUNTED TO BLOWER HOUSING

BACKGROUND OF THE INVENTION

FIELD OF THE INVENTION

The present invention generally pertains to electric motor mounting assemblies and, more specifically, to an improved assembly for mounting an electric motor to a blower housing within a household clothes dryer.

DESCRIPTION OF RELATED ART

Electric motors for household clothes dryers conventionally have a blower drive shaft to turn a fan or blower wheel and an oppositely-extending, coaxial drum drive shaft to turn a belt which rotatably drives a drum of the clothes dryer. Each drive shaft extends from a hub which facilitates mounting of the motor within the clothes dryer cabinet.

Typically, the hubs are attached to a sheet metal motor cradle which extends upwardly from a base plate or panel of the dryer cabinet. A metal strap extends over the top surface of each hub and releasably secures the hubs to the motor cradle.

A blower housing is secured to the cabinet base panel adjacent the motor. The blower drive shaft extends through an aperture in the blower housing, and has a fan or blower wheel mounted thereto. As such, the blower housing and the motor are independently mounted to the cabinet base and, due to manufacturing tolerances, misalignment between the blower drive shaft and the blower housing is common.

This arrangement may make it difficult to insert the blower drive shaft through the opening provided for it in the blower housing. It may also result in the blower wheel being misaligned with respect to the space in the blower housing, and the blower wheel may strike the blower housing. Therefore, the manufacturer may be forced to enlarge the space or opening in the blower housing which receives the blower wheel. However, maximum blower efficiency requires a minimum clearance between the blower housing and the blower wheel.

Therefore, there exists a need in the art for a motor assembly which permits greater precision in the assembly of the blower wheel to the blower drive shaft within the blower housing to enable the blower efficiency to be increased.

One attempt to improve upon the foregoing state of the art is shown by U.S. Pat. No. 5,133,617, the entire disclosure of which is expressly incorporated herein by reference. The '617 patent discloses a motor mount assembly which positively aligns a fan or blower shaft with a fan housing. The motor mount assembly includes a ring assembly having an external rigid ring and an internal resilient ring which are coaxially aligned with each other. The ring assembly is secured to a motor hub and cooperates with a cylindrical socket formed on the fan housing to secure the motor to the fan housing. The exterior surface of the external ring includes a series of fingers which interlock with a mating series of fingers provided on an inner radial surface of the fan housing socket to mount the motor to the blower housing.

While the motor mounting apparatus and method of the '617 patent may remove some of the deficiencies found in the prior art, it creates other problems that may be equally troublesome. For example, the '617 mounting scheme requires rotation of the motor to interlock the external ring with the fan housing. This operation may be difficult to perform, requires numerous parts, and may be expensive to implement.

Therefore, there remains a need in the art for an inexpensive and simple means for reliably securing and aligning the motor to the blower housing in a domestic clothes dryer.

SUMMARY OF THE INVENTION

The present invention provides a blower housing assembly which reliably secures and aligns an electric motor to a blower housing in a domestic clothes dryer.

According to the present invention, an assembly for attaching an electric motor to a blower housing includes a support member projecting outwardly from a surface of the blower housing, a cylindrical hub secured to the motor, and a locking member for releasably securing the hub to the support member. The locking member is releasably secured to the blower housing and cooperates with the support member to retain the hub adjacent the blower housing.

In further accordance with the present invention, the blower housing includes a bowl-shaped portion having a curved sidewall and a planar endwall and an arcuate tubular portion extending from the bowl-shaped portion. A blower housing cover is secured to the sidewall and overlies an open end of the bowl-shaped portion opposite the endwall. The cover is formed of metal and electrically connects a thermostat, which is mounted thereto, to ground via a metal fastener.

BRIEF DESCRIPTION OF THE DRAWING FIGURES

These and further features of the present invention will be apparent with reference to the following description and drawings, wherein.

DETAILED DESCRIPTION OF THE PREFERRED EMBODIMENT

Figure 1:
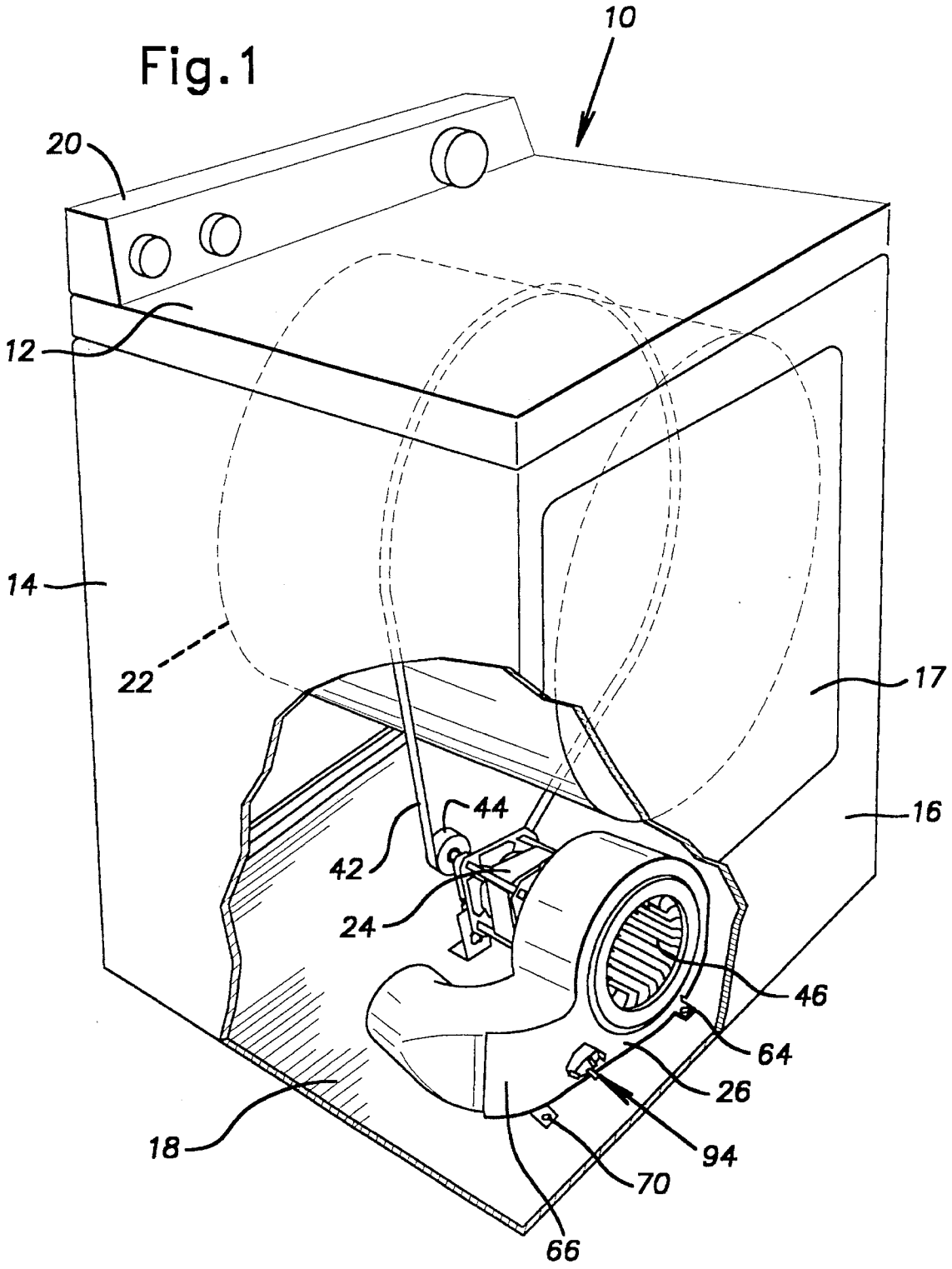
FIG. 1 is a perspective view of a domestic clothes dryer incorporating the present invention.

With reference to FIG. 1, a household clothes dryer 10 according to the present invention is shown. The dryer 10 includes a cabinet having a horizontal top panel 12, a pair of lateral or side panels 14 (one shown), a front panel 16, a bottom panel 18, and a rear panel (not shown). A control console 20 extends upwardly from the rear of the top panel 12. The front panel 16 defines an access opening 17 through which a user may gain access into the interior of a dryer drum 22. The front panel also has a door (not shown) hingedly mounted thereto to cover the access opening when the dryer 10 is in use.

The drum 22 is conventionally mounted at its front and rear ends, via front and rear bulkheads (not shown), to the front and rear cabinet panels. Reference should be made to commonly-owned U.S. Pat. Nos. 5,216,823 and 5,363,569, the entire disclosures of which are expressly incorporated herein by reference, for more information on rotationally mounting of the drum 22 within the cabinet.

A heater assembly (not shown), an electric motor 24, an air transfer duct (not shown), and a blower housing 26 are mounted within the cabinet. The heater assembly is preferably located at a rear, bottom portion of the cabinet and heats air prior to its introduction into the rear of the drum 22 via the rear bulkhead. The motor 24 and blower housing 26 are secured to the bottom panel 16 by mechanical fasteners, such as screws, as will be discussed more fully hereafter.

Heated air from the heater assembly flows through the drum 22 from back to front, passes through a blade-type lint filter (not shown) carried by the front bulkhead, and flows into the air transfer duct which is secured to the front bulkhead. The air then travels through the transfer duct and a conduit or pipe (not shown) to the blower housing 26. The conduit or pipe attaches to an intake of the blower wheel at a blower cover, as will be apparent from the description to follow. Reference should be made to commonly-owned U.S. Pat. No. 5,317,816, the entire disclosure of which is expressly incorporated herein by reference, for more information on air transfer ducts.

Figure 2:
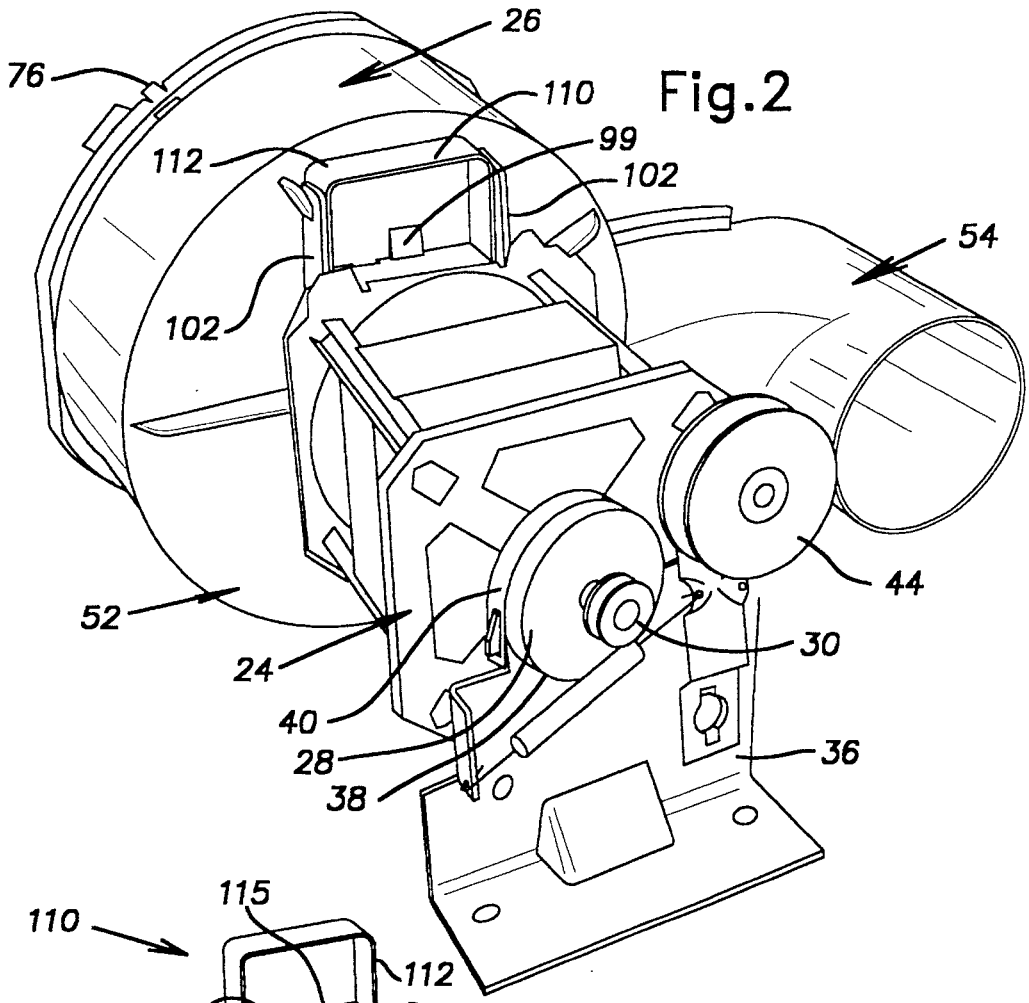
FIG. 2 is a perspective view of an electric motor, base panel, and blower housing of the clothes dryer shown in FIG. 1.
Figure 4:
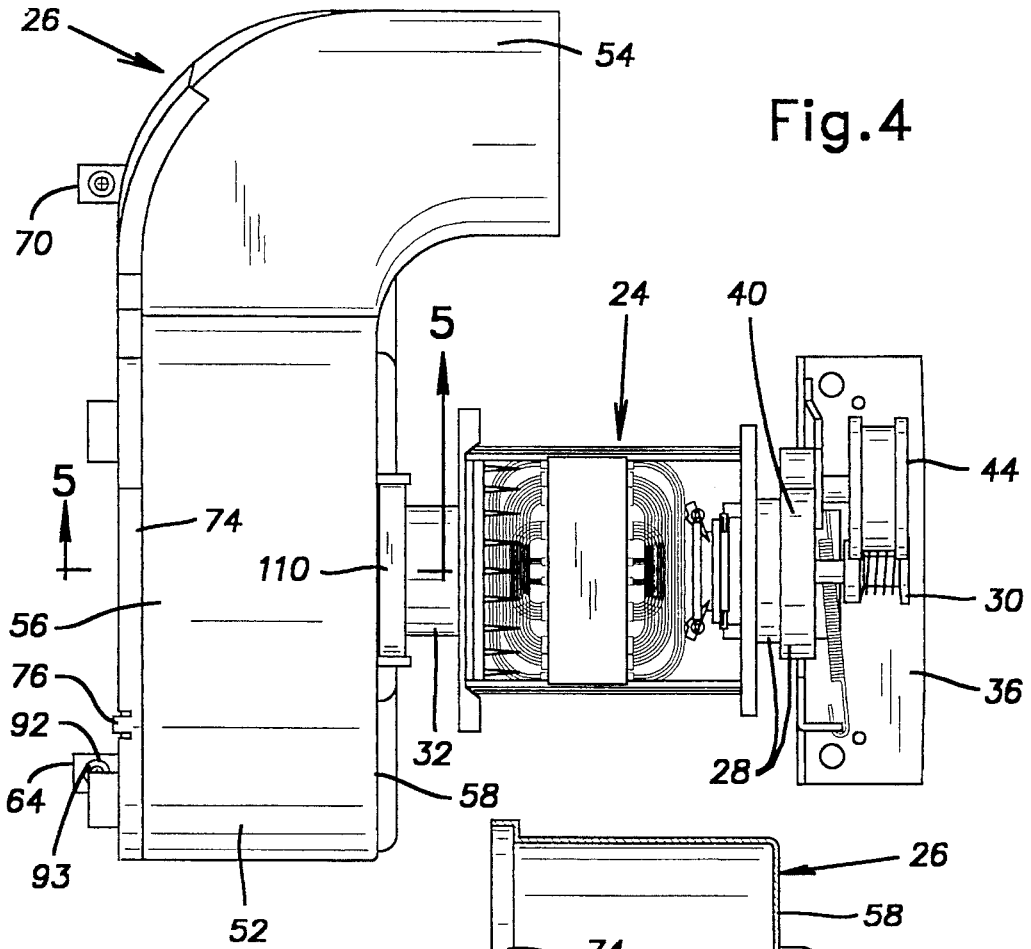
FIG. 4 is a top plan view of the blower housing, motor, and locking member according to the present invention.

With reference to FIGS. 2 and 4, the electric motor 24 is located rearwardly adjacent the blower housing 26 and has a first motor hub 28 from which a drum drive shaft 30 extends and a second motor hub 32 from which a blower drive shaft 34 extends. A mounting bracket 36, which is attached to the bottom panel 16 by conventional mechanical means, has a semi-circular upper surface 38 which engages a curved lower surface of the first motor hub 28 and thereby supports the drum-end of the motor 24.

A metal strap 40 resiliently extends over the first motor hub 28 and is secured at each end to the mounting bracket 36 to thereby releasably attach the first motor hub 28 to the cabinet bottom panel 16 via the mounting bracket 36. The metal strap 40 and the mounting bracket 36 cooperate to transfer the motor torque to the bottom panel 16.

A drum drive belt 42 extends around the drum 22, over a tensioning or idler pulley 44, and around a distal end of the drum drive shaft 30, as shown best in FIG. 1. The drum drive shaft 30 turns the belt 42 which, in turn, rotates the drum 22. For more information on the mounting of the drum end of the motor 24, and the operation and mounting of the tensioning or idler pulley 44, reference should be made to commonly assigned U.S. patent application Ser. No. 08/453,231, filed May 30, 1995, the entire disclosure of which is expressly incorporated herein by reference.

The blower drive shaft 34 extends into the blower housing 26 and has a blower wheel or fan 46 secured thereto. A distal end of the blower drive shaft 34 preferably includes a flat surface 33 and has an annular groove 35 (FIG. 5) formed therein. A central hub portion 48 of the blower wheel 46 includes an opening to index and receive the distal end of the blower drive shaft, and one or more resilient arms (not shown) which snap-fit into the annular groove 35 in the blower drive shaft 34 and retain the blower wheel 46 on the drive shaft 34. Naturally, numerous equivalent arrangements are known in the art for attaching a rotatable shaft to a fan or blower wheel hub, and the arrangement described herein is merely provided to illustrate the preferred embodiment of the present invention currently contemplated by the inventors.

Figure 5:
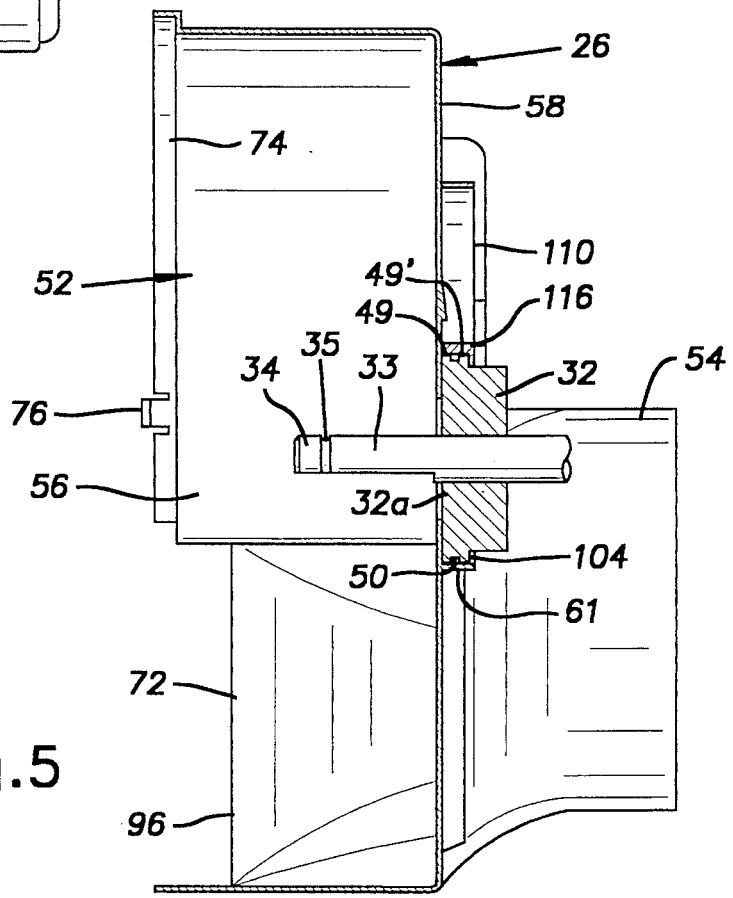
FIG. 5 is an assembled cross-sectional view of the hub, blower housing, and locking member as viewed along line 5—5 of FIG. 4.
Figure 6:
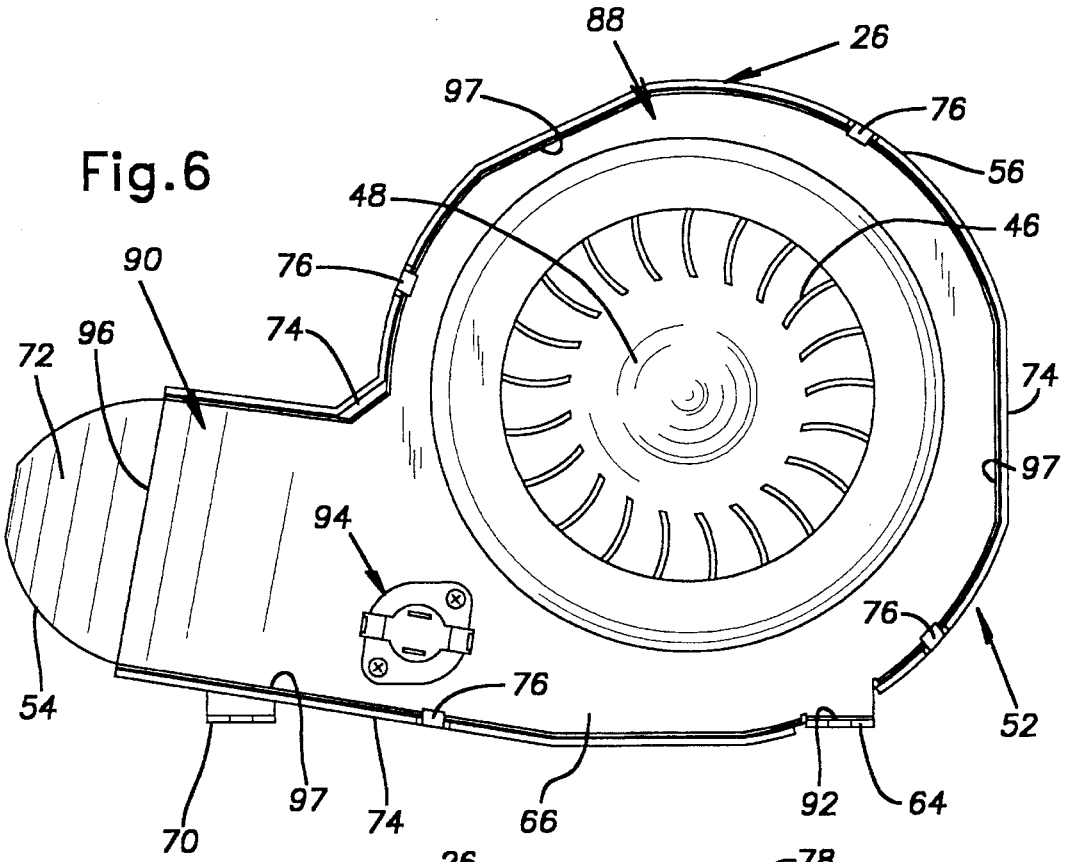
FIG. 6 is a rear elevational view of the blower housing and a blower housing cover.

The blower drive shaft 34 extends from the second motor hub 32. The second motor hub 32 has an enlarged portion **32*a* including first and second raised annular ribs 49, 49' which are spaced apart a short distance to define an annular channel or groove 50 therebetween (FIG. 5). The enlarged portion 32*a* facilitates securing the second motor hub 32 to the blower housing 26**, as will be described hereafter.

With reference to FIGS. 2–5, the blower housing 26, which is preferably formed or molded from a plastic material, includes a bowl-shaped blower receiving portion 52 which is integrally connected to an arcuate tubular portion 54. The bowl-shaped portion 52 includes a curved sidewall 56 and a planar endwall 58. The planar endwall 58 has a support member 60 projecting outwardly therefrom to receive the second motor hub 32 and has a hole 62 formed therein through which the blower drive shaft 34 extends. A first mounting foot 64 extends downwardly from the bowl-shaped portion 52 and engages the bottom panel 16. A circular open end of the bowl-shaped portion 52 opposite the planar end wall 58 is partially covered by a metallic blower cover 66, as will be described hereafter.

As should be clear from the drawing figures, the tubular portion 54 extends radially outwardly and away from the bowl-shaped portion 52, and bends rearwardly so that an outlet 68 of the tubular portion is generally parallel with the end wall 58 of the bowl-shaped portion 52. A conduit (not shown) connects to the tubular portion outlet 68 and transmits air from the blower housing 26 to external exhaust. A second mounting foot 70 extends downwardly from the tubular portion 54 and is secured to the bottom panel 16.

Figure 7:
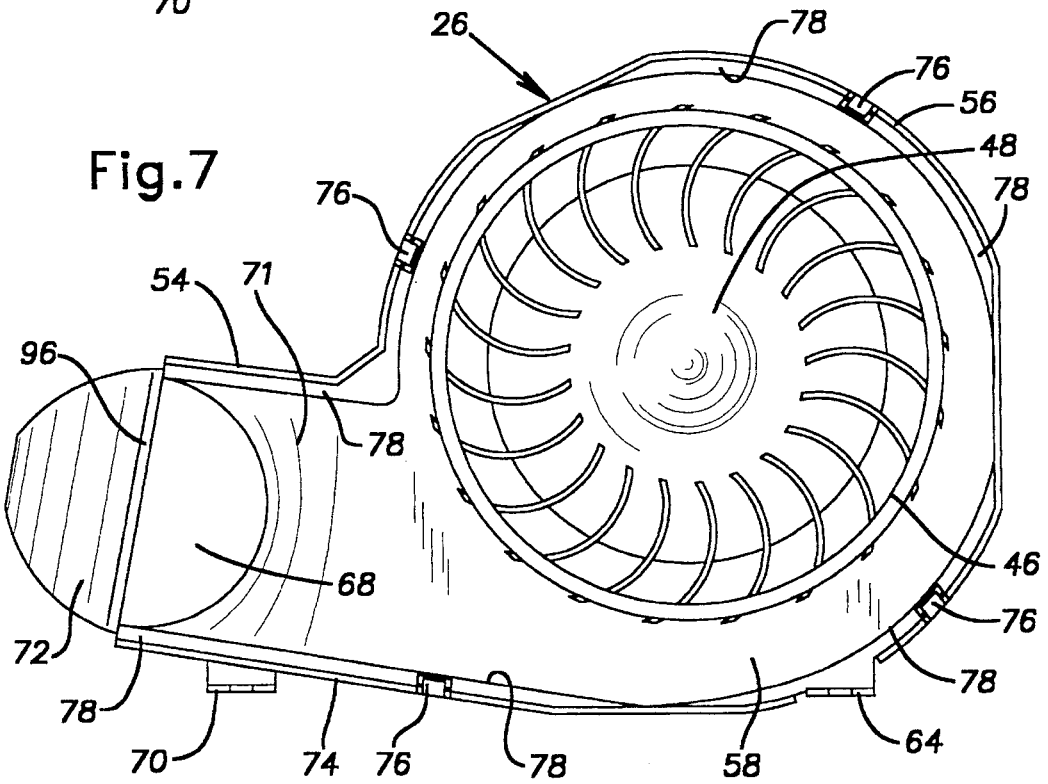
FIG. 7 is a rear elevational view of the blower housing similar to that shown in FIG. 6, but with the blower housing cover removed.

The tubular portion 54 has an opening 71 formed in a forward sidewall 72 thereof which is contiguous with the circular open end of the bowl-shaped portion 52. The opening 71 in the tubular portion 54 and the open end of the bowl-shaped portion 54 are surrounded by a thickened rim 74 which includes a series of resilient hooked arms 76 and defines an inner peripheral ledge 78 (FIG. 7). The ledge 78 and hooked arms 76 cooperate to secure the blower cover 66 to the blower housing 26, as will be described more fully hereafter.

The blower cover 66 is preferably formed or stamped sheet metal, and includes a ring-shaped portion 88 and a generally rectangular portion 90 integrally extending from the ring-shaped portion 88. The ring-shaped portion 88 overlies the circular open end of the bowl-shaped portion 52. The periphery of the ring-shaped portion 88 is supported by the ledge 78 and held in place by the resilient hooked arms 76. An annular area surrounding the open center of the ring-shaped portion 88 is stepped or spaced outwardly from a plane defined by the remainder of the ring-shaped portion 88. The opening in the ring-shaped portion defines a passageway for air from the conduit (not shown), which is attached to the ring-shaped portion 88, to enter the blower housing 26.

The periphery of the ring-shaped portion 88 includes a downwardly and outwardly extending tab-like member 92 which is secured to the first mounting foot 64 and the bottom panel 16 by a screw 93 (FIG. 4). The screw 93 serves to ground the blower cover 66 to the cabinet bottom panel 16.

The blower cover 66 has a thermostat 94 mounted thereto by conventional mechanical fasteners. More specifically, the thermostat 94 extends through the blower cover 66 and is operable to sense the temperature within the blower housing 26 downstream of the blower wheel 46. Necessary electrical connections are made to the thermostat 94, and the thermostat 94 is grounded via the conductive blower cover 66, and the screw 93 to the bottom panel 18 of the dryer cabinet.

The rectangular portion 90 of the blower cover 66 includes upper and lower peripheral edges which rest upon the ledge 78 and are held in place by the resilient hooked arms 76. A distal edge of the rectangular portion 90 is received under a rim 96 provided by the tubular portion 54.

The periphery of the blower cover 66, with the exception of the distal edge of the rectangular portion 90, includes an upstanding flange 97. The flange 97 includes an outer surface which is engaged by the resilient hooked arms 76.

Figure 3:
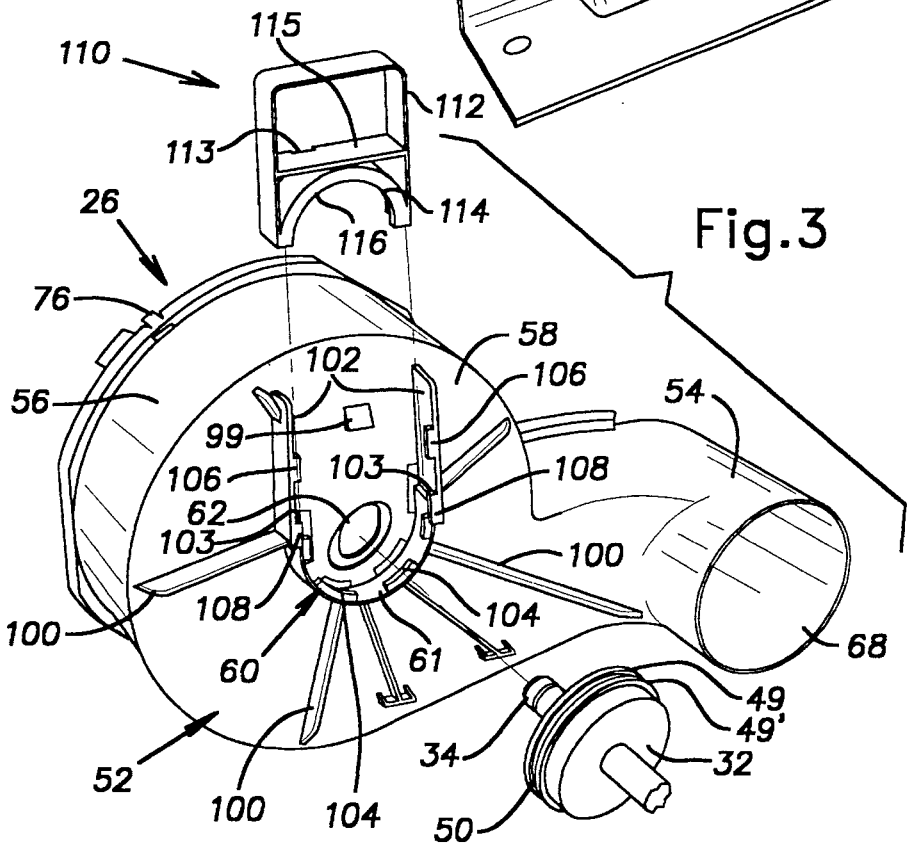
FIG. 3 is an exploded perspective view of a motor hub, locking member, and the blower housing shown in FIG. 2.

With reference to FIG. 3, the planar endwall 58 of the bowl-shaped portion 52 is shown to include, in addition to the support member 60, a ramping retaining tab 99, and a series of stiffening ribs 100. The retaining tab 99 projects outwardly and downwardly from the planar endwall 58, as shown best in FIGS. 2 and 3.

As illustrated best in FIGS. 3 and 5, the support member 60 includes a generally arcuate receiving portion 61 and a pair of parallel guides 102 which extend integrally upwardly from opposed lateral sides of the arcuate receiving portion 61 and project outwardly from the planar endwall 58, as illustrated. A pair of stop surfaces 103 are defined by a pair of horizontal edge surfaces provided by the arcuate receiving portion 61 inboard of the guides 102. The arcuate receiving portion 61 has a curved upper surface from which a series of tabs 104 project radially inwardly. The tabs 104 are designed to abuttingly engage the second annular rib 49' provided by the enlarged portion **32*a* of the second motor hub 32 and thereby help retaining and secure the second motor hub to the blower housing endwall 58. Naturally, it is contemplated that the separate tabs 104 could be replaced by a continuous rib or other structures without departing from the basic function provided by the tabs 104**.

The guides 102 each include upper and lower guide tabs 106, 108. The guide tabs 106, 108 extend laterally from one guide 102 toward the other. The lower guide tabs 108 are outwardly adjacent and abut an edge surface of the support member 60.

A locking member 110 is slidably received between the guides 102, between the guide tabs 106, 108 and the planar endwall 58, and between the retaining tab 99 and the stop surfaces 103. The locking member includes a handle portion 112, an arcuate securing portion 114, and a brace member 115. The brace member 115 has a notch 113 formed therein to facilitate release of the locking member 110 from the retaining tab 99 and permit removal of the locking member 110 from the blower housing 26. The arcuate securing portion 114 has a curved lower surface generally matching the radius of the receiving portion 61.

The arcuate receiving portion 61 cooperates with the arcuate securing portion 114 to define a generally continuous annular socket for receipt of the second motor hub 32. More specifically, the arcuate securing portion 114 includes a continuous rib 116 which surrounds the upper half of the second motor hub 32 adjacent the second annular rib 49' provided by the enlarged portion **32*a* of the second motor hub 32, and thereby cooperates with the tabs 104 to removably secure the second motor hub 32 to the blower housing 26**.

As will be apparent from the drawings and the discussion to follow, the enlarged portion **32*a* is generally trapped between the rib 116 and the tabs 104 and the planar housing endwall 58 and is thereby prevented from moving in a direction parallel to the blower drive shaft 34 (i.e., toward or away from the endwall 58). The arcuate securing portion 114 and the arcuate receiving member 61 also cooperate to define a socket that radially surrounds the enlarged portion 32*a* and thereby prevents any movement of the second motor hub 32 at an angle to the blower drive shaft 34**.

Assembly of the motor 24, blower housing 26, blower wheel 46, and blower cover 66 will hereafter be discussed with reference to the foregoing description and drawings. Initially, the mounting bracket 36 is mounted to the bottom panel 18 and the motor 24 is positioned such that the first motor hub 28 is positioned on the semi-circular upper surface 38 of the mounting bracket 36. The metal strap 40 is employed to removably secure the first motor hub 28 to the mounting bracket 36.

The blower housing 26 is then positioned on the bottom panel 18 such that the blower drive shaft 34 extends through the hole 58 in the blower housing endwall 58, and the enlarged portion **32*a* of the second motor hub 32 rests upon the support member 60 extending from the blower housing endwall 58. More specifically, the enlarged portion is positioned upon the arcuate receiving portion 61 such that the first annular rib 49 is adjacent the planar endwall 58 and the second annular rib 49' is adjacent the tabs 104. At this point, a screw may be inserted through the second mounting foot 70 and into the bottom panel 18 to partially secure the blower housing 26** to the cabinet.

The blower wheel 46 is inserted into the open end of the bowl-shaped portion 52 of the blower housing 26 and pushed onto the blower drive shaft 34 to allow the resilient arms (not shown) provided by the hub portion 48 to snap-fit into the annular groove 35 of the blower drive shaft 34. Due to the flat surface 33 of the blower drive shaft 34, the opening in the wheel hub portion 48 must be properly aligned or indexed with the blower wheel hub portion 48, as will be apparent to one skilled in the art. With the blower wheel 46 attached to the blower drive shaft 34, the blower housing cover 66 can be secured to the blower housing 26.

The distal edge of the blower cover rectangular portion 90 is inserted under the rim 96 provided by the tubular portion 54, and the blower housing ring-shaped portion 88 is pivoted toward the open end of the blower housing 26. The peripheral flange 97 of the blower cover 66 engages and outwardly deforms the hooked arms 76 provided by the blower housing 26. Further pushing of the blower cover 66 causes the hooked arms 76 to snap-fit over the flange 97 such that the periphery of the blower cover 66 is received between the peripheral ledge 78 and the hooked arms 76.

The tab-like member 92 rests upon the first mounting foot 64 and is secured, via screw 93, to the bottom panel 16. As such, the conductive blower cover 66, including the tab-like member 92, and the screw 93 provide or define a path to electrical ground for the thermostat 94, which is secured to the blower cover, as illustrated and discussed hereinbefore. The blower cover 66, tab-like member 92, and screw 93 thus eliminate the need for separate grounding required in the prior art.

Thereafter, the locking member 110 is inserted between the guides 102 and pushed downwardly toward the support member 60. The arcuate securing portion 114 is deformed slightly outwardly as it passes over the retaining tab 99 extending from the endwall 58. Further downward movement of the locking member 110 positions the rib 116 adjacent the second annular rib 49' provided by the enlarged portion **32*a* and causes the retaining tab 99 to snap-fit over the brace member 115. The arcuate securing portion 114 and the arcuate receiving portion 61 cooperate to define a generally continuous annular socket which radially surrounds the enlarged portion 32*a* of the second motor hub 32**.

As such, the bottom surface of the locking member 110 is in contact with the stop surfaces 103 of support member 60.

The retaining tab 99 and the support member 60 cooperate to vertically and laterally restrain the locking member 110 and the second motor hub 32. The upper and lower guide tabs 106, 108 cooperate with the planar endwall 58 to prevent movement of the locking member 110 and the second motor hub 32 in a direction parallel to the blower drive shaft 34 (i.e., toward or away from the planar endwall 58). The tabs 104 and the rib 116 cooperate to prevent both vertical and horizontal movement of the second motor hub 32, as noted hereinbefore.

The locking member 110 may be removed from the blower housing 26 simply by inserting a thin tool, such as a screwdriver (not shown) into the notch 113 in the brace member 115 and prying the locking member away from the endwall 58. When the brace member 115 clears the retaining tab 99, the locking member 110 is removed by pulling the handle portion 112 and vertically sliding the locking member between the guides 102.

The foregoing description of the present invention is not to be construed in a limitative manner, but rather is provided to clearly illustrate the preferred embodiment presently contemplated by the inventors, and does not alter the scope of the invention as defined by the claims appended hereto.

What is claimed is:

1. An assembly for attaching an electric motor to a blower housing, said assembly comprising:

a support member projecting outwardly from a surface of said blower housing;

a generally cylindrical motor hub secured to said motor, said motor hub having a blower shaft extending outwardly therefrom and being engaged and supported by said support member; and, a locking member which engages said motor hub and releasably secures said motor hub to said support member, said locking member being releasably secured to said blower housing and cooperating with said support member to retain said motor hub in position relative to said blower housing.

2. An assembly according to claim 1, wherein said locking member is releasably snap-fit to said blower housing.

3. An assembly according to claim 2, wherein said locking member includes an arcuate securing portion and said support member includes an arcuate receiving portion, said securing and receiving portions cooperating to define an annular socket which surrounds said hub.

4. An assembly according to claim 3, wherein said hub includes an enlarged portion and said securing portion includes a radially inwardly extending tab which is positioned adjacent said enlarged portion.

5. An assembly according to claim 3, wherein said hub includes an enlarged portion and said receiving portion includes a radially inwardly extending rib which is positioned adjacent said enlarged portion.

6. An assembly according to claim 2, wherein said blower housing includes a tab which engages said locking member and prevents unintended disengagement of said locking member from said blower housing.

7. An assembly according to claim 1, wherein said locking member includes an arcuate securing portion and said support member includes an arcuate receiving portion, said securing and receiving portions cooperating to define an annular socket which radially surrounds said motor hub.

8. An assembly according to claim 7, wherein said hub includes an enlarged portion and said socket includes a radially inwardly extending rib which is positioned adjacent said enlarged portion.

9. An assembly according to claim 6, wherein said locking member defines a slotted opening, said slotted opening permitting insertion of a tool between said blower housing and said locking member to move said locking member out of engagement with said tab and permit disengagement of said locking member from said blower housing.

10. A blower housing assembly for a domestic clothes dryer, comprising:

a blower housing having a blower receiving portion and an arcuate tubular portion, said blower receiving portion comprising a curved sidewall and a generally planar endwall, said endwall defining an opening through which a blower wheel drive shaft extends;

a blower housing cover overlying an open end of said blower receiving portion, said cover defining an opening through which air may enter said blower housing;

means for securing said cover to said housing; and means for mounting a motor hub to said blower housing.

11. A blower housing assembly according to claim 10, wherein said mounting means comprises a support member and a locking member, said support member being integrally formed with said endwall and said locking member being releasably secured to said endwall.

12. A blower housing assembly according to claim 11, wherein said locking member includes an arcuate securing portion and said support member includes an arcuate receiving portion, said securing and receiving portions cooperating to define an annular socket which radially surrounds said motor hub.

13. A blower housing assembly according to claim 12, wherein said hub defines an enlarged portion and said socket includes a radially inwardly extending rib which is positioned adjacent said enlarged portion.

14. A blower housing assembly according to claim 10, wherein said securing means comprises a plurality of resilient hooked arms extending from said curved sidewall and engaging said cover.

15. A blower housing assembly according to claim 10, wherein a metal fastener secures the blower cover to a bottom panel of the clothes dryer.

16. A blower housing assembly according to claim 15, further comprising a thermostat mounted to said blower cover and operable to sense air temperature within said blower housing, said thermostat being electrically connected to the bottom panel via said cover and said metal fastener.

17. A domestic clothes dryer comprising:

a cabinet comprising a base panel;

a drum mounted for rotation within said cabinet;

means for rotating said drum, said means including an electric motor;

means for supplying air to said drum, said supply means comprising a blower assembly, said blower assembly comprising:

a blower housing having an endwall defining an opening through which a drive shaft of said electric motor may extend;

a blower wheel mounted on said drive shaft and received within said blower housing;

a blower housing cover overlying an open end of said blower housing, said cover defining an opening through which air may enter said blower housing;

means for mounting a motor hub to said blower housing.

18. A domestic clothes dryer according to claim 17, wherein said mounting means comprises a support member and a locking member, said support member being integrally formed with said endwall and said locking member being releasably attached to said endwall.

19. A domestic clothes dryer according to claim 18, wherein said locking member includes an arcuate securing portion and said support member includes an arcuate receiving portion, said securing and receiving portions cooperating to define an annular socket which radially surrounds a portion of said hub.

20. A domestic clothes dryer according to claim 19, wherein said securing portion and said receiving portion each include a radially inwardly extending rib which abuts said hub portion to secure said hub to said housing.

* * * * *